US005912649A

United States Patent [19]

Hattori et al.

[11] Patent Number: 5,912,649

[45] Date of Patent: Jun. 15, 1999

[54] ELECTRO-LUMINESCENT DISPLAY APPARATUS

[75] Inventors: Yutaka Hattori, Okazaki; Shoichi Onda, Toyokawa; Tomohiro Yonekawa, Anjo; Nobuei Ito, Chiryu; Tadashi Hattori, Okazaki, all of Japan

[73] Assignee: Denso Corporation, Kariya, Japan

[21] Appl. No.: 08/791,784

[22] Filed: Jan. 29, 1997

[30] Foreign Application Priority Data

Feb. 13, 1996 [JP] Japan ..... 8-025564

[51] Int. Cl.[6] ..... G09G 5/00

[52] U.S. Cl. ..... 345/4; 345/7; 345/9; 345/76

[58] Field of Search ..... 345/76, 7, 9, 4; 315/169

[56] References Cited

U.S. PATENT DOCUMENTS

| | | | |
|---|---|---|---|
| 5,053,679 | 10/1991 | Thioulouse | 315/169 |
| 5,354,202 | 10/1994 | Moncrief et al. | 345/4 |
| 5,734,357 | 3/1998 | Matsumoto | 345/7 |
| 5,760,931 | 6/1998 | Saburi et al. | 345/7 |

FOREIGN PATENT DOCUMENTS

| | | |
|---|---|---|
| 62-123692 | 6/1987 | Japan . |
| 2-46695 | 2/1990 | Japan . |
| 3-276593 | 12/1991 | Japan . |
| 7-10939 | 3/1995 | Japan . |
| 7-169570 | 7/1995 | Japan . |
| 7-261677 | 10/1995 | Japan . |
| 7-320869 | 12/1995 | Japan . |
| 8-96960 | 4/1996 | Japan . |

*Primary Examiner*—Richard A. Hjerpe
*Assistant Examiner*—Kamran Malik
*Attorney, Agent, or Firm*—Pillsbury Madison & Sutro LLP

[57] ABSTRACT

An electro-luminescent display apparatus which is capable of displaying two kinds of images is disclosed. The apparatus has a front and a rear electro-luminescent unit therein, and the green light emitted from the front unit directly displays the real image which looks close to a viewer while the orange light emitted from the rear unit is reflected by a reflector disposed at the back of the apparatus and displays a virtual image which looks far from the viewer. In order to reflect the light emitted backward from the front unit and the light emitted forward from the rear unit, reflecting electrodes are provided on the rear surface of the front unit or a reflecting film is disposed in the space between the front and the rear units.

11 Claims, 9 Drawing Sheets

ELECTRO-LUMINESCENT DISPLAY APPARATUS

CROSS-REFERENCE TO RELATED APPLICATION

This application is based upon and claims benefit of priority of Japanese Patent Application No. Hei-8-25564 filed on Feb. 13, 1996, the content of which is incorporated herein by reference.

BACKGROUND OF THE INVENTION

1. Field of the Invention

The present invention relates to an electroluminescent ( hereinafter referred to as EL ) display apparatus using EL units.

2. Description of Related Art

An EL display apparatus which has been conventionally used is composed of a luminescent layer, insulating layers sandwiching the luminescent layer and a pair of electrodes further sandwiching the insulating layers. Images are displayed by imposing voltages on the pair of electrodes in either form of a pattern display or a matrix display. These displays, however, are shown in a single plane having no depth of the images.

SUMMARY OF THE INVENTION

The present invention has been made in view of the above-mentioned problem, and an object of the present invention is to provide an EL display apparatus which is capable of showing images with depth thereof, i.e., real images are shown close to a viewer and virtual images are shown far from the viewer.

An EL display apparatus according to the present invention is composed of an EL panel 100 having a first EL unit 10 disposed on a front substrate 1 of the panel and a second EL unit 20 disposed on a rear substrate 2 of the panel, and a reflector 5 for reflecting light from the second EL unit disposed at the back of the EL panel. Real images are shown on a first display area "A" by the direct light from the first display unit, and virtual images are shown on a second display area "B" by the light which is emitted from the second EL unit and reflected by the reflector.

Since the lengths of the light path of the real and virtual images are different from each other, two images are displayed with different distances, i.e., the former is displayed close to the viewer and the latter far from the viewer. To intercept the light emitted forward from the second EL unit, there are provided reflecting surfaces disposed on the back of electrodes of the first EL unit or in a space between the first and the second EL units.

Real images having a mixed color can be also displayed on a third display area "C", if desired. Moreover, the reflected light displaying the virtual images may be led directly to the front substrate without going through the first EL unit, preventing deterioration of transparency thereof.

Other objects and features of the present invention will become more readily apparent from a better understanding of the preferred embodiments described below with reference to the following drawings.

DETAILED DESCRIPTION OF THE PREFERRED EMBODIMENTS

Figure 1:
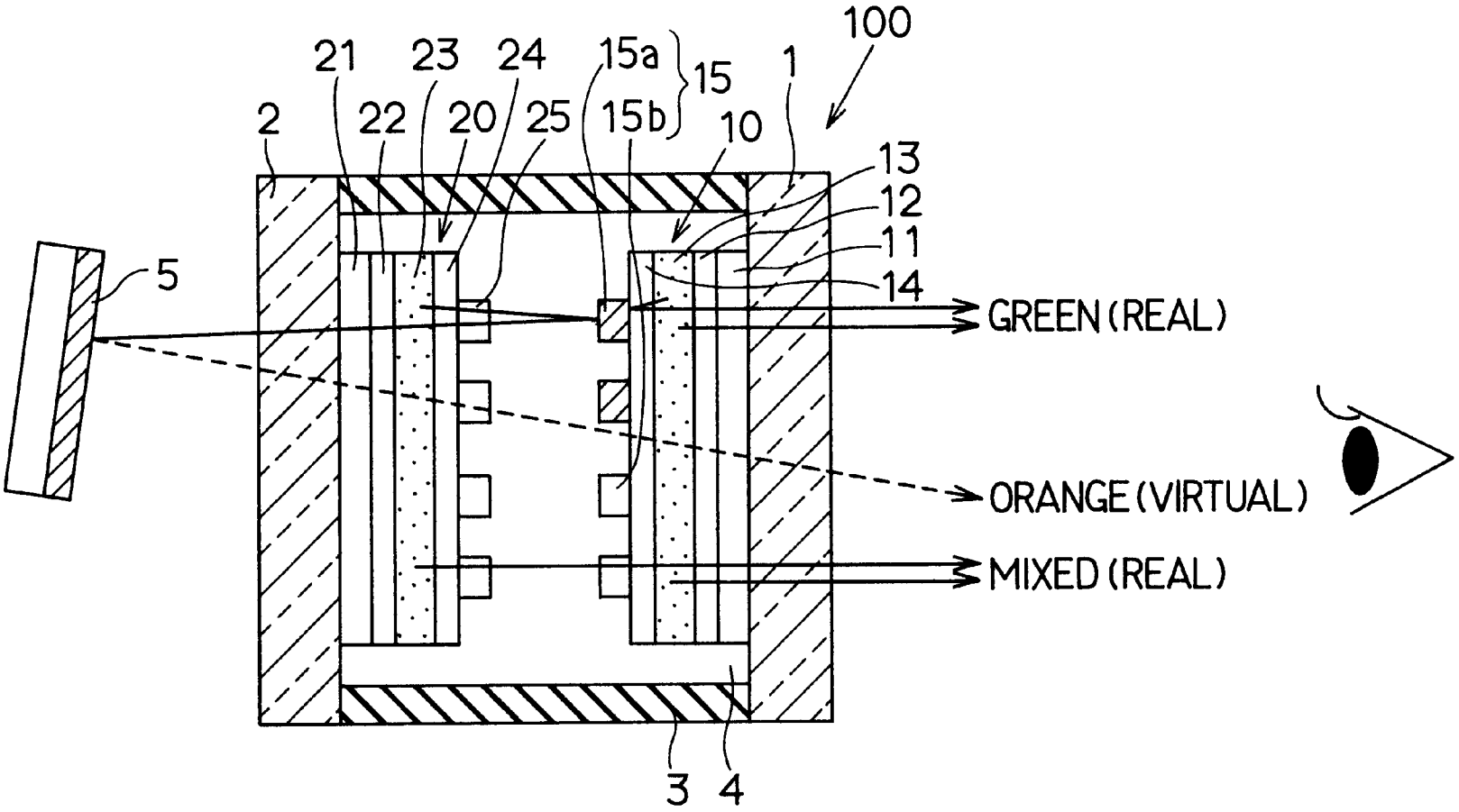
FIG. 1 is a conceptual cross-sectional view showing a first embodiment of an EL display apparatus according to the present invention.

FIG. 1 shows a conceptual cross-section of the first embodiment of an EL apparatus according to the present invention Referring to FIG. 1, a first EL unit 10 is disposed on a front substrate 1 made of a transparent glass. The first EL unit 10 is composed of first transparent electrodes 11, a first insulating layer 12, a luminescent layer 13, a second insulating layer 14 and second electrodes 15. The second electrodes 15 include reflecting electrodes 15*a* (hatched electrodes in FIG. 1) made of aluminum and transparent electrodes 15*b*. Light from the back passes through the region where the transparent electrodes 15*b* are formed and is reflected on the region where the reflecting electrodes 15*a* are formed. The first electrodes 11 and the second electrodes 15 are arranged to form a matrix, crossing perpendicularly each other. The luminescent layer 13 is made of a mother material such as ZnS and a luminescent center material such as Tb added to the mother material. The first EL unit 10 emits a green light by supplying a voltage thereto.

On a rear substrate 2 made of a transparent glass plate, a second EL unit 20 is disposed. The second EL unit is composed of first transparent electrodes 21, a first insulating layer 22, a luminescent layer 23, a second insulating layer 24 and second transparent electrodes 25. The second EL unit emits light to both sides. The first and second transparent electrodes 21 and 25 are arranged to form a matrix, crossing perpendicularly each other. The luminescent layer 23 is made of a mother material such as ZnS and a luminescent center material such as Mn added to the mother material The second EL unit emits an orange light by supplying a voltage thereto.

The front substrate 1 having the first EL unit 10 disposed thereon and the rear substrate 2 having the second EL unit 20 disposed thereon are assembled hermetically using a sealing material 3, and a transparent insulating material such as silicone oil is filed in the space between the first and second EL units. Thus, the EL panel 100 is completed.

At the back of the second EL unit 20, a reflector 5 which reflects the light emitted from the second EL unit 20 is disposed. The insulating layers 12, 14, 22 and 24, and the luminescent layers 13 and 23 are, of course, all transparent.

The EL display Apparatus described above displays real images in a green color on the first display area "A" with the light emitted from the first EL unit 10. It displays virtual images in an orange color on the second display area "B" with the light emitted from the second EL unit 20 and reflected on the reflecting electrodes 15a and reflected again on the reflector 5, and the direct light emitted from the second EL unit 20 and reflected on the reflector 5. Further, it displays real images in a green-orange mixed color on the third display area "C" with the direct lights from both EL units 10 and 20. Among the three displays described above, the orange color display has a longer light path compared with others, therefore, it is observed by a viewer as it has a longer distance from the viewer The virtual images in an orange color are realized, in this embodiment, by using the reflected light from the second EL unit. The virtual images, however, may be changed to real images by using only the direct light from the second EL unit.

Figure 2:
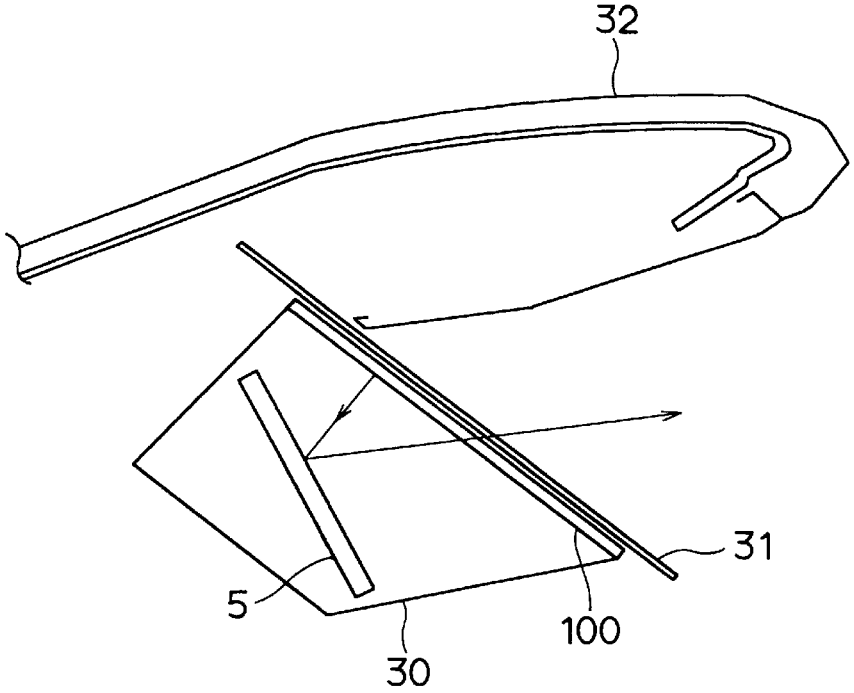
FIG. 2 is a conceptual view showing an instrument panel of a vehicle in which an EL display apparatus according to the present invention is installed.

FIG. 2 shows a conceptual view of an instrument panel of an automobile in which the EL display apparatus according to the present invention is used. The EL panel 100 and the reflector 5 are installed in an instrument case 30 which is disposed under an instrument hood 32. A transparent front cover 31 is disposed in front of the EL panel 100.

Figure 3:
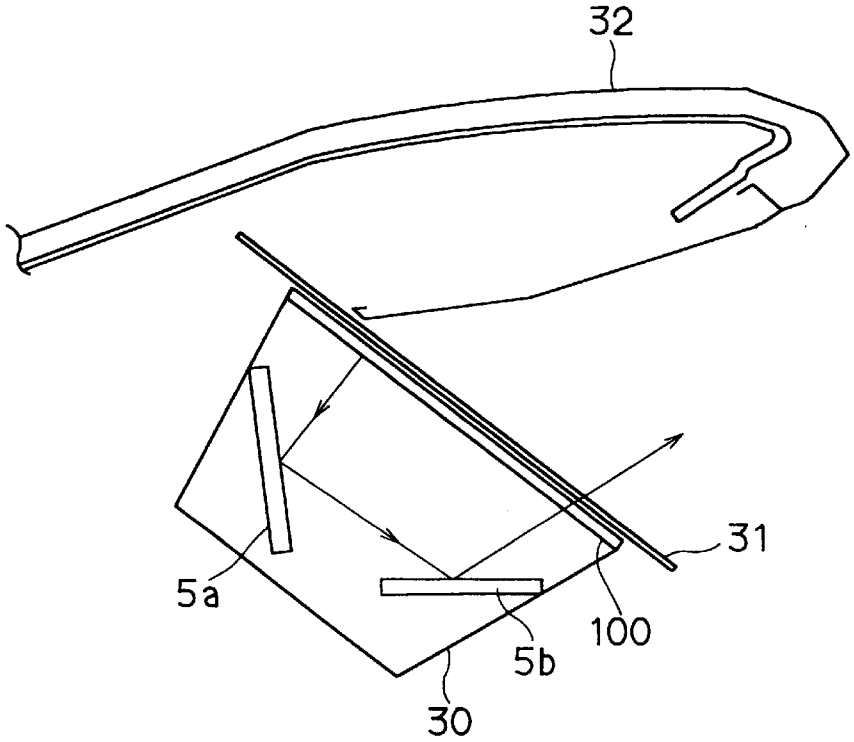
FIG. 3 is a conceptual view showing a modified arrangement of the instrument panel shown in FIG. 2.

FIG. 3 shows a modification of the arrangement shown in FIG. 2 in which two reflectors 5*a* and 5*b* are used in place of the reflector 5 of FIG. 2. In this modified arrangement, the virtual images displayed have a longer light path, and accordingly the virtual images are observed by a viewer as they are shown farther away from the viewer.

Figure 4:
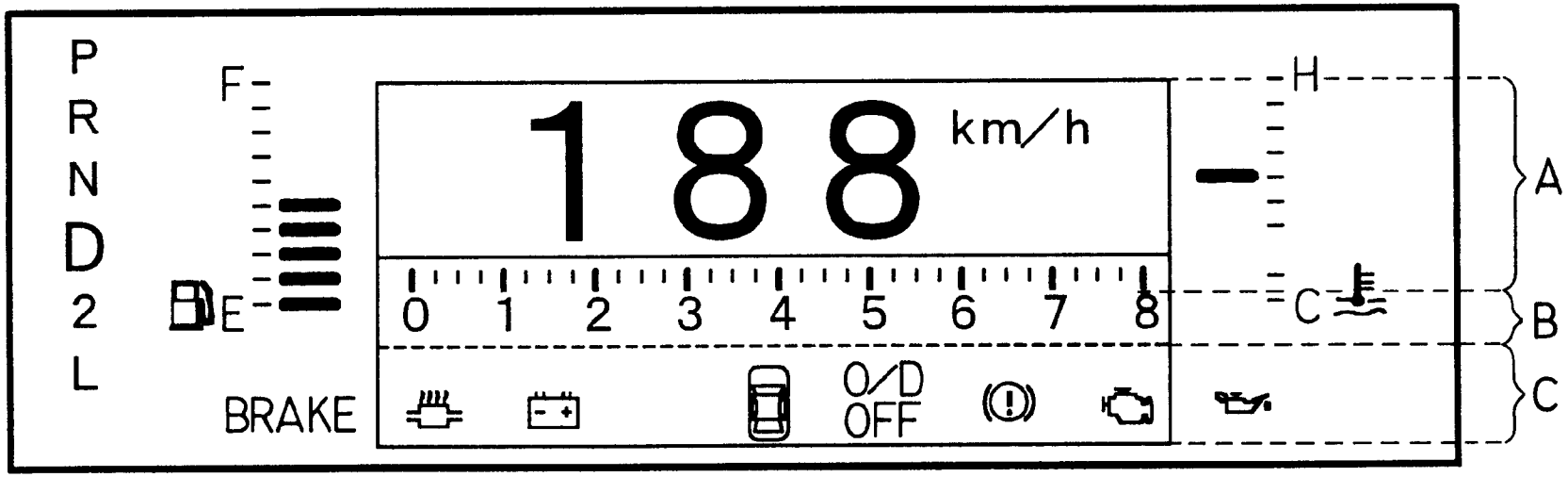
FIG. 4 is an example of an instrument panel design in which the EL display apparatus according to the present invention is used.
Figure 5:
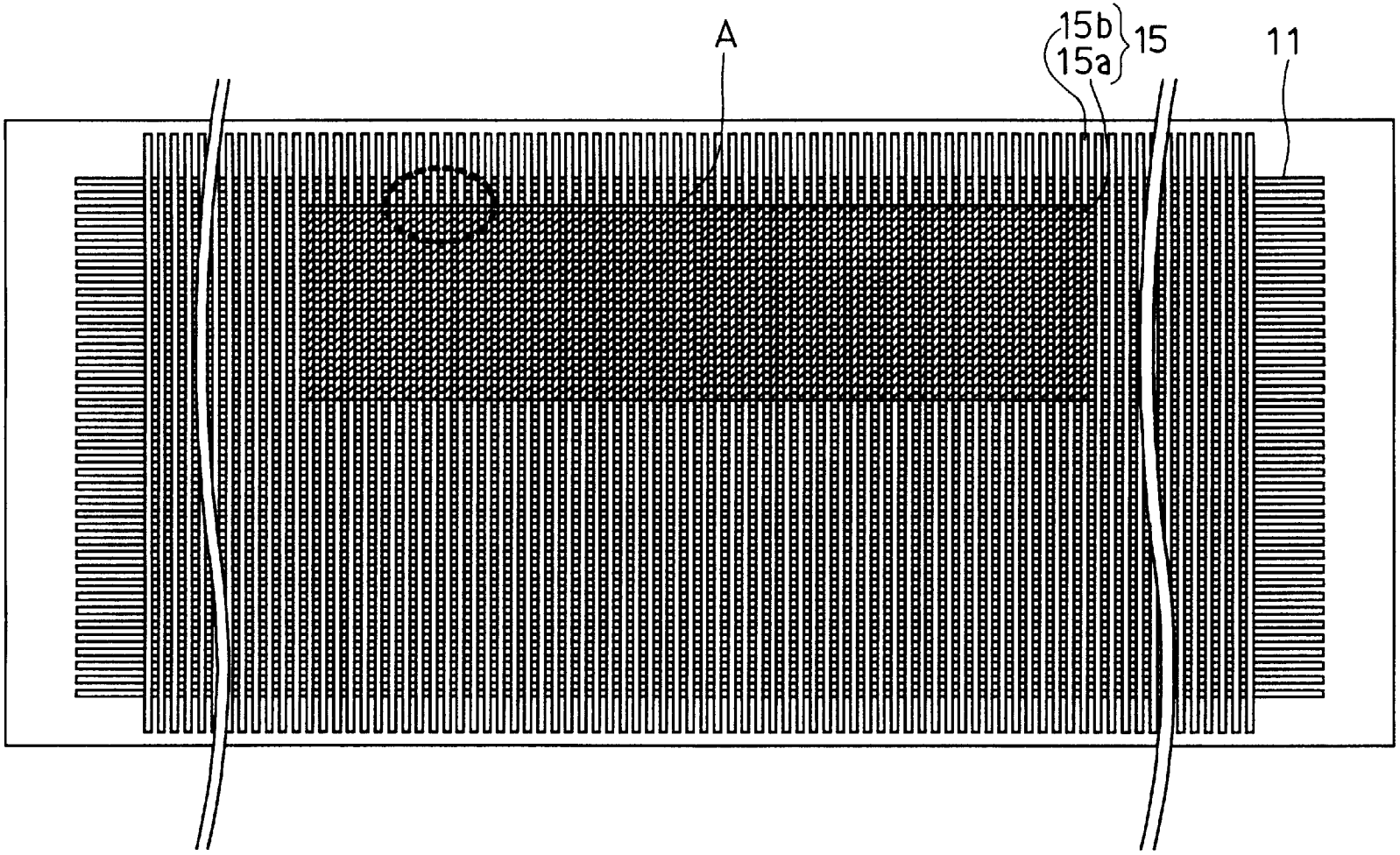
FIG. 5 is a plan view showing a pattern of first electrodes and second electrodes of the first EL unit shown in FIG. 1.
Figure 6:
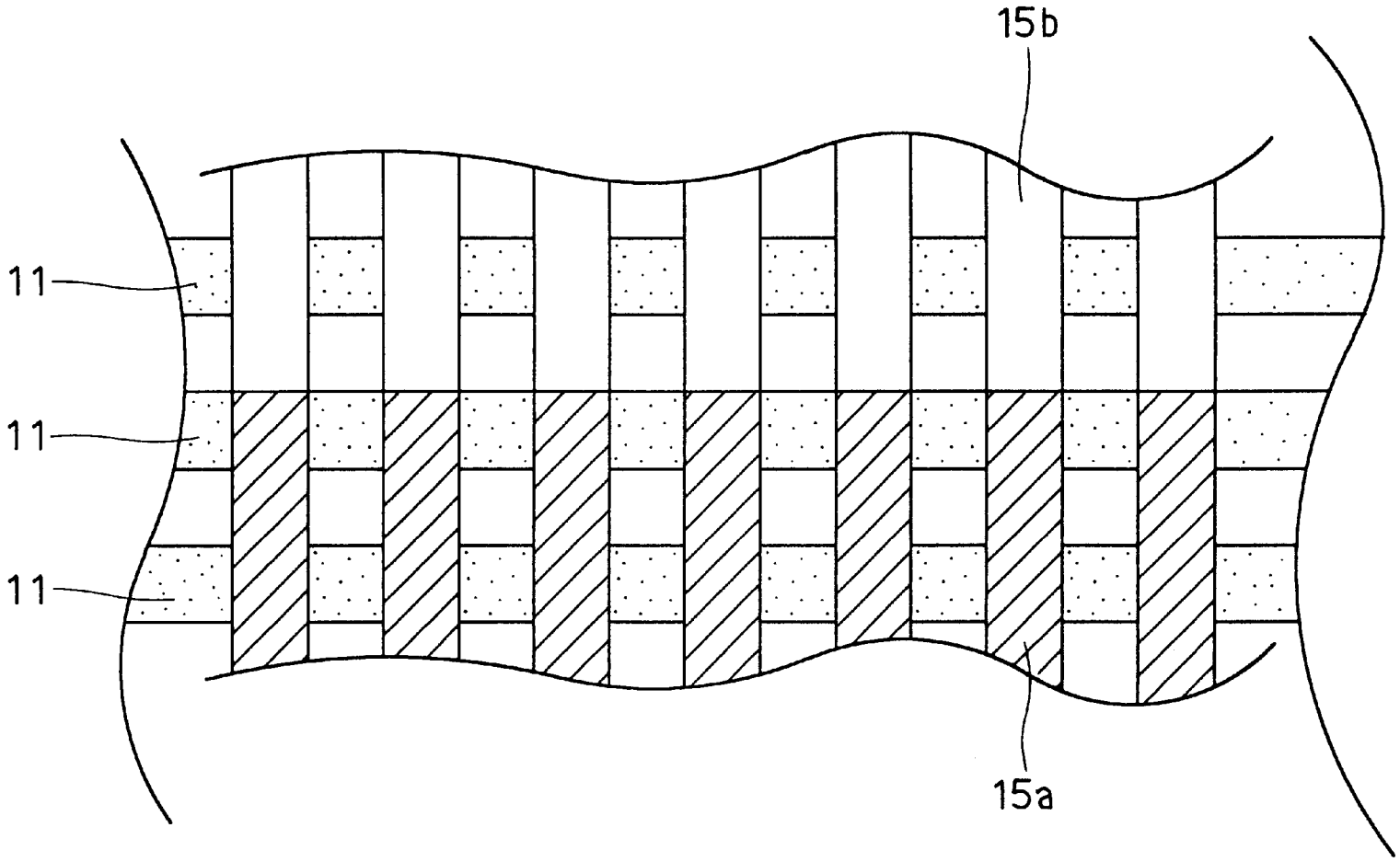
FIG. 6 is a plan view showing a partially enlarged portion encircled in FIG. 5.

FIG. 4 shows an example of displays on an instrument panel in which the EL display apparatus according to the present invention is used. On the first display area "A", a speed of a vehicle is displayed in a real image having a green color using the direct light from the first EL unit 10. Also, a scale for an engine rotational speed is displayed similarly in a real image having a green color. On the second display area "B", figures representing engine speeds are displayed in a virtual image of an orange color using the light emitted from the second EL unit 20 and reflected on the reflector 5. On the third display area "C", icons showing various information such as battery conditions are displayed in a real image of a green-orange mixed color using the direct light from both of the first and second EL units. Other pieces of information on the right and left sides of the instrument panel such as a cooling water temperature, an amount of gasoline left in a tank, and etc. are displayed in real images of a green, orange or mixed color thereof according to the designs desired In FIG. 5, a pattern of the first and second electrodes 11 and 15 of the first EL unit 10 which is designed to realized the display shown in FIG. 4 is shown. A portion of the electrode pattern encircled in FIG. 5 is shown in FIG. 6 in an enlarged scale. As shown these drawings, the first and second electrodes 11 and 15 constitute a matrix pattern In the first display area "A", aluminum reflecting electrodes 15*a* are formed. Since the reflecting electrodes 15*a* are formed at positions respectively facing the second electrodes 25 of the second EL unit, the direct light from the second EL unit is intercepted and reflected by the reflecting electrodes 15*a*. Therefore, only the real image of a green color from the first EL unit is displayed on the display area "A".

Figure 7:
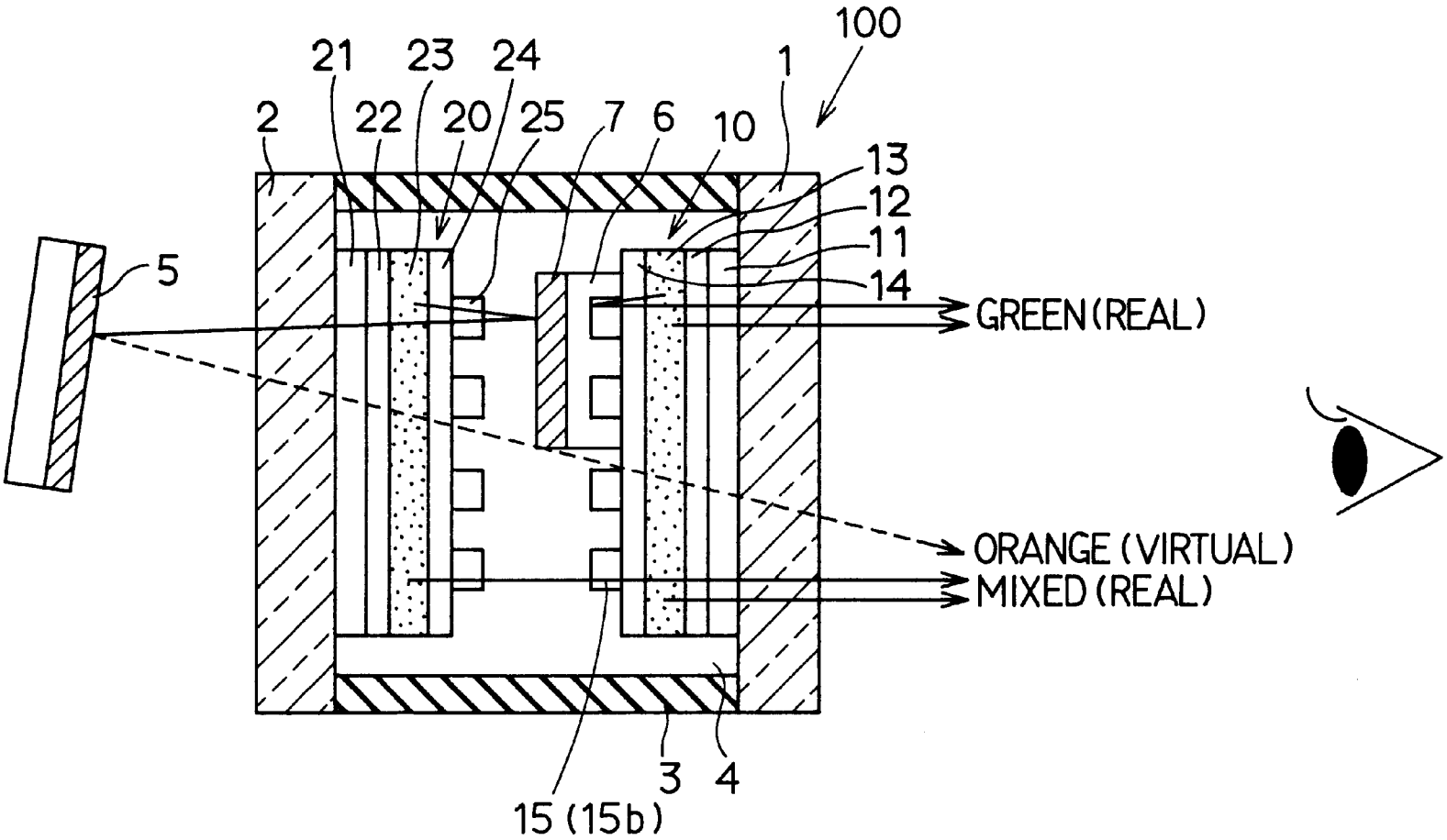
FIG. 7 is a conceptual cross-sectional view showing a second embodiment of an EL display apparatus according to the present invention.

In FIG. 7, a second embodiment according to the present invention is shown. In this embodiment, a reflecting film 7 is disposed in the space between the first and second EL units for performing the same function as the reflecting electrodes 15*a* of the first embodiment. The reflecting electrodes 15*a* of the first embodiment are replaced by transparent electrodes 15*b* in the second embodiment. All of the second electrodes 15 of the first EL unit are made of a transparent material such as an ITO, and SiN (Silicon Nitride) insulating layer 6 with a thickness of 300 nm is formed thereon by sputtering Then, an aluminum reflecting film 7 with a thickness of 100 nm is formed on the insulating layer 6 by sputtering. This embodiment, also, displays the same images as the first embodiment, i.e., the real image of a green color is displayed on the first display area "A", the virtual image of an orange color on the second display area "B", and the real image of a mixed color on the third display area "C".

Figure 8:
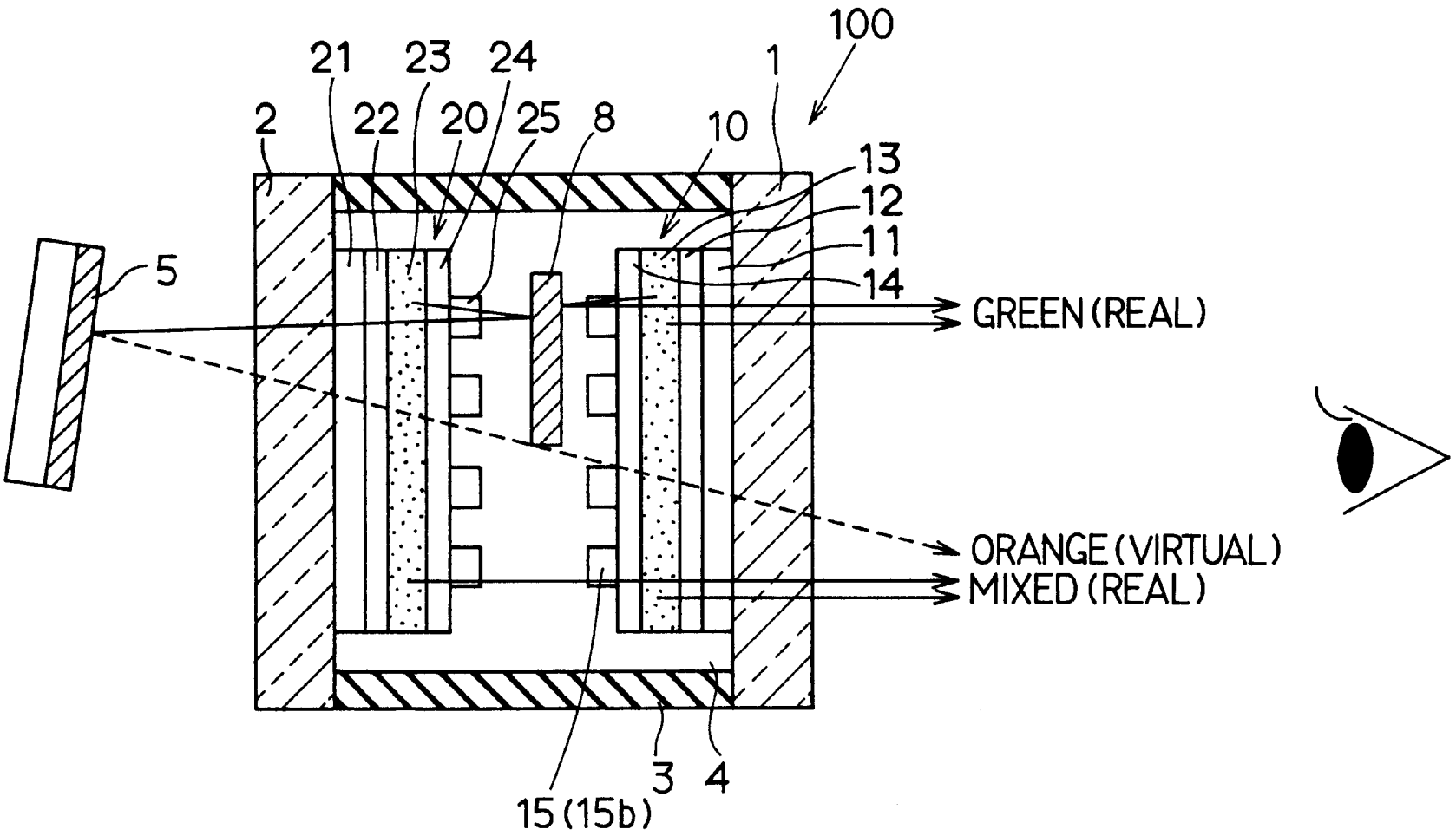
FIG. 8 shows a modification of the second embodiment shown in FIG. 7.

FIG. 8 shows a modification of the second embodiment shown in FIG. 7. An aluminum thin film 8 is inserted in the space between the first and second EL units in place of the reflecting film 7 of the second embodiment when they are assembled. In this modification, the thin film 8 is disposed in the space where silicone oil is filled, therefore, it is hard to fix the thin film position. To fix the position of the thin film in the space, a transparent film having the same size as the space may be used. In this case, the edges of the thin film are fixed to the sealing material 3, and its portion corresponding to the first display area "A" is made of a material reflecting light such as aluminum.

Figure 9:
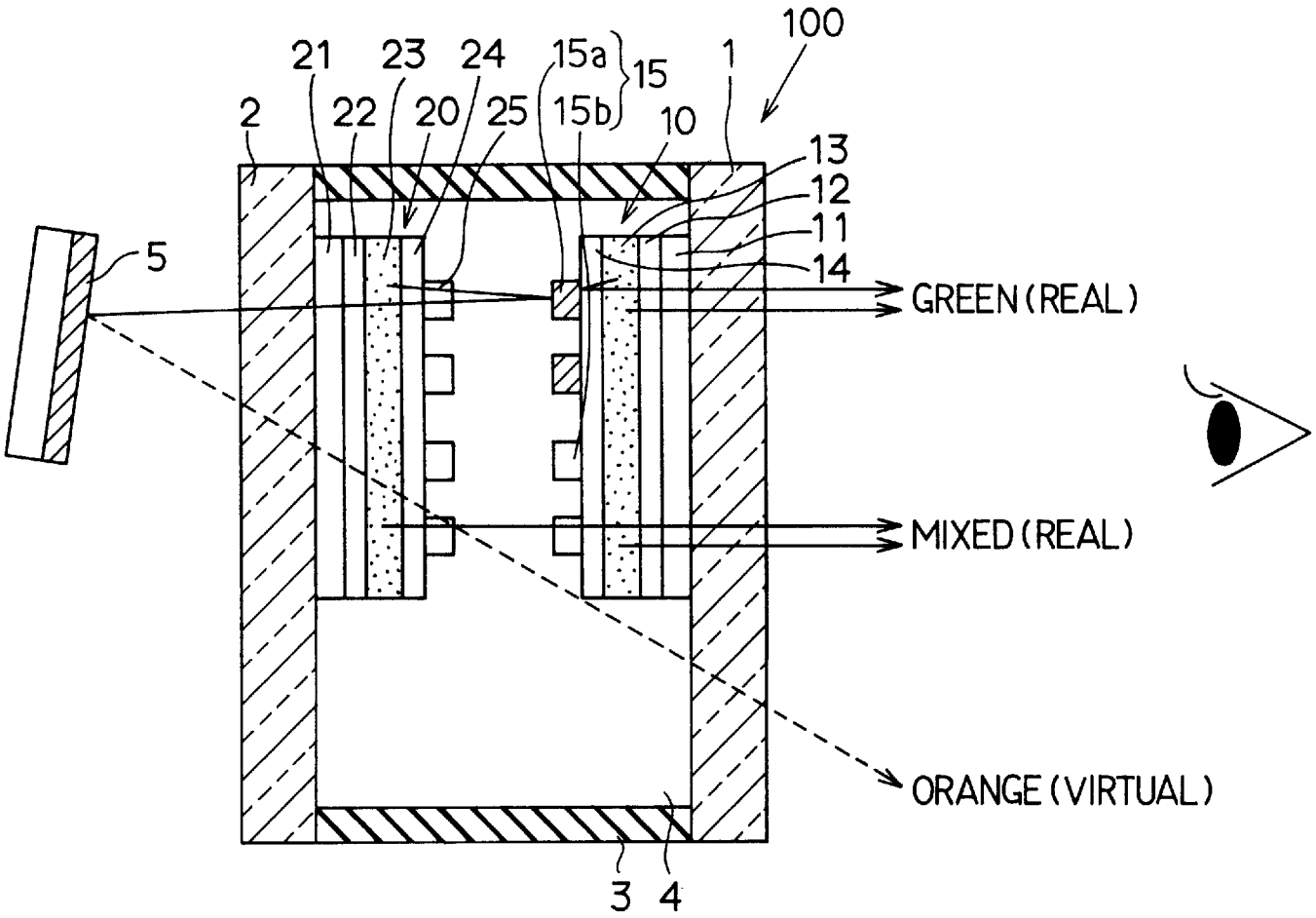
FIG. 9 is a conceptual cross-sectional view showing a third embodiment of an EL display apparatus according to the present invention.

FIG. 9 shows a third embodiment according to the present invention. In the foregoing first and second embodiments, the reflected orange light displaying the virtual image comes out through the first EL unit 10, sacrificing a certain amount of its intensity. In this third embodiment, the size of the front and rear substrates 1 and 2 is enlarged so that the reflected orange light comes out directly through the front substrate 1 without passing through the thirst EL unit. Accordingly, the orange light intensity can be made higher. The arrangement of the third embodiment, of course, can be applied also to the embodiments shown in FIGS. 7 and 8, though FIG. 9 shows the embodiment corresponding to the first embodiment shown in FIG. 1.

Figure 10:
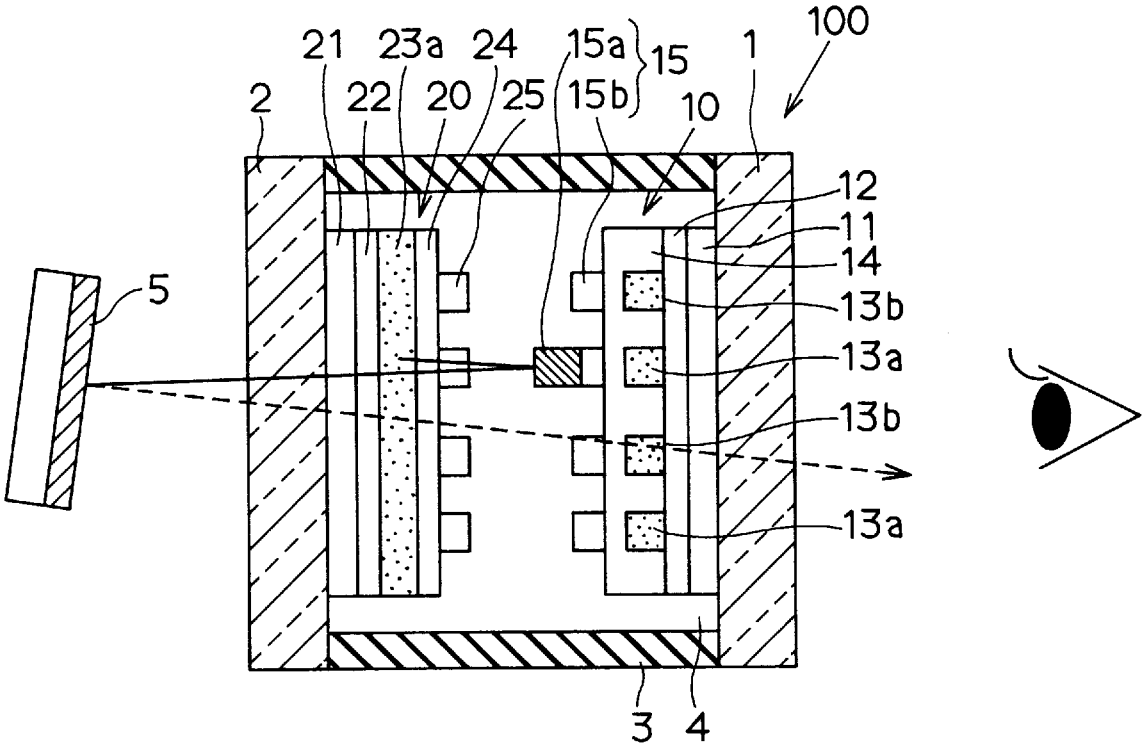
FIG. 10 is a conceptual cross-sectional view showing a fourth embodiment of an EL display apparatus according to the present invention.

In all the foregoing embodiments, displays are made only in green, orange and green-orange mixed colors. FIG. 10 shows a fourth embodiment of the present invention in which a display in a blue color is added. The first EL unit 10 of the fourth embodiment has two kinds of luminescent layers 13*a* emitting a green light and 13*b* emitting an orange light, which are disposed alternately on the first insulating layer 12 as shown in FIG. 10. As the luminescent layer of the second EL unit, a luminescent layer 23*a* emitting a blue light is used. Thus, the EL display apparatus displays real images of green and orange colors, a virtual image of blue color, and real images of blue-green mixed and blue-orange mixed colors. It is also possible to display a real image of a blue color.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An electro-luminescent display apparatus having at least a first and a second display area, comprising:

a first electro-luminescent unit disposed at a front side of the apparatus;

a second electro-luminescent unit disposed at a rear side of the apparatus;

a reflector disposed at the back of the second electro-luminescent unit for reflecting light emitted from the second electro-luminescent unit; and means for reflecting light emitted backward from the first electro-luminescent unit and light emitted forward from the second electro-luminescent unit; wherein:

a real image is displayed on the first display area by the light emitted forward from the first electro-luminescent unit; and a virtual image is displayed on the second display area by the light reflected on the reflector.

2. An electro-luminescent display apparatus having a first, a second and a third display area, comprising:

a first electro-luminescent unit disposed at a front side of the apparatus;

a second electro-luminescent unit disposed at a rear side of the apparatus;

a reflector disposed at the back of the second electro-luminescent unit for reflecting light emitted from the second electro-luminescent unit; and means for reflecting light emitted backward from the first electro-luminescent unit and light emitted forward from the second electro-luminescent unit; wherein:

a real image is displayed on the first display area by the light emitted forward from the first electro-luminescent unit;

a virtual image is displayed on the second display area by the light reflected on the reflector; and a real image is displayed on the third display area by the light emitted forward from both of the first and second electro-luminescent units.

3. An electro-luminescent display apparatus according to claim 1 or 2, wherein the reflecting means is electrodes disposed on a rear surface of the first electro-luminescent unit.

4. An electro-luminescent display apparatus according to claim 1 or 2, wherein the reflecting means is a reflecting film disposed in a space between the first and the second electro-luminescent units.

5. An electro-luminescent display apparatus according to claim 1 or 2, wherein the virtual image is displayed without passing through the first electro-luminescent unit.

6. An electro-luminescent display apparatus according to claim 1 or 2, wherein:

the apparatus further includes a front transparent substrate on which the first electro-luminescent unit is disposed and a rear transparent substrate on which the second electro-luminescent unit is disposed;

the front and rear substrates are bonded together hermetically to contain the first and second electro-luminescent units therein with a space between the first and second electro-luminescent units;

the first electro-luminescent unit includes two sets of electrodes, and a luminescent layer and insulating layers which are all sandwiched between the sets of electrodes, a set of electrodes at the front side being transparent for passing the light therethrough, at least a portion of a set of electrodes at the rear side being transparent; and the second electro-luminescent unit includes two sets of transparent electrodes, and a luminescent layer and insulating layers which are all sandwiched between the sets of the transparent electrodes.

7. An electro-luminescent display apparatus according to claim 6, wherein the reflecting means is a portion of the set of electrodes at the rear side of the first electro-luminescent unit.

8. An electro-luminescent display apparatus according to claim 6, wherein the reflecting means is a reflecting film disposed in the space between first and second electro-luminescent units.

9. An electro-luminescent display apparatus according to claim 6, wherein the light transmitted from the second electro-luminescent unit and reflected on the reflector displays a virtual image through the transparent electrode portion at the rear side of the first luminescent unit.

10. An electro-luminescent display apparatus according to claim 2, wherein the direct light emitted from the second luminescent unit passes through the first luminescent unit and displays a real image on the third display area.

11. An electro-luminescent display apparatus according to claim 6, wherein the two sets of electrodes of the respective first and second luminescent units are arranged to constitute an electrode matrix, respectively, one set of electrodes crossing perpendicularly the other set of electrodes.

* * * * *